US005325874A

United States Patent [19]

Heitmann

[11] Patent Number: 5,325,874

[45] Date of Patent: Jul. 5, 1994

[54] APPARATUS FOR REMOVING SURPLUS FROM A STREAM OF FIBROUS MATERIAL

[75] Inventor: Uwe Heitmann, Hamburg, Fed. Rep. of Germany

[73] Assignee: Körber AG, Hamburg, Fed. Rep. of Germany

[21] Appl. No.: 9,092

[22] Filed: Jan. 26, 1993

[30] Foreign Application Priority Data

Jan. 28, 1992 [DE] Fed. Rep. of Germany ..... 4202198

[51] Int. Cl.[5] ..... A24C 5/18

[52] U.S. Cl. ..... 131/84.4; 131/84.1

[58] Field of Search ..... 131/84.4, 84.1, 83.1; 493/39, 42, 47, 50; 83/100, 162, 164, 914; 408/203.5; 409/137, 138, 157, 228

[56] References Cited

U.S. PATENT DOCUMENTS 4,651,755 3/1987 Rudszinat ..... 131/84.4
4,729,386 3/1988 Heitmann ..... 131/84.4 X

FOREIGN PATENT DOCUMENTS 1167719 4/1964 Fed. Rep. of Germany ..... 131/84.4
2152301 1/1979 Fed. Rep. of Germany ..... 131/84.4
928029 6/1963 United Kingdom ..... 131/84.4
1009664 11/1965 United Kingdom ..... 131/84.4

*Primary Examiner*—Jennifer Doyle
*Attorney, Agent, or Firm*—Darby & Darby

[57] ABSTRACT

A tobacco stream which contains a surplus of tobacco particles is conveyed in a channel past a trimming device which serves to remove the surplus and has two disc-shaped tobacco engaging members extending through openings in the sidewalls of the channel and into the stream in such a way that the surplus is located at one side and the remainder of the stream is located at the other side of the plane of the tobacco engaging members. These members are rotated in opposite directions, and their marginal portions come nearest to each other at a point normally midway between the sidewalls. A rotating tube is disposed at the one side of the tobacco engaging members and has a serrated or smooth cutting edge which removes the surplus only, or practically only, at the aforementioned point. Such surplus is evacuated by suction through the tube whose axis makes an oblique angle with the direction of advancement of the stream in the channel.

16 Claims, 1 Drawing Sheet

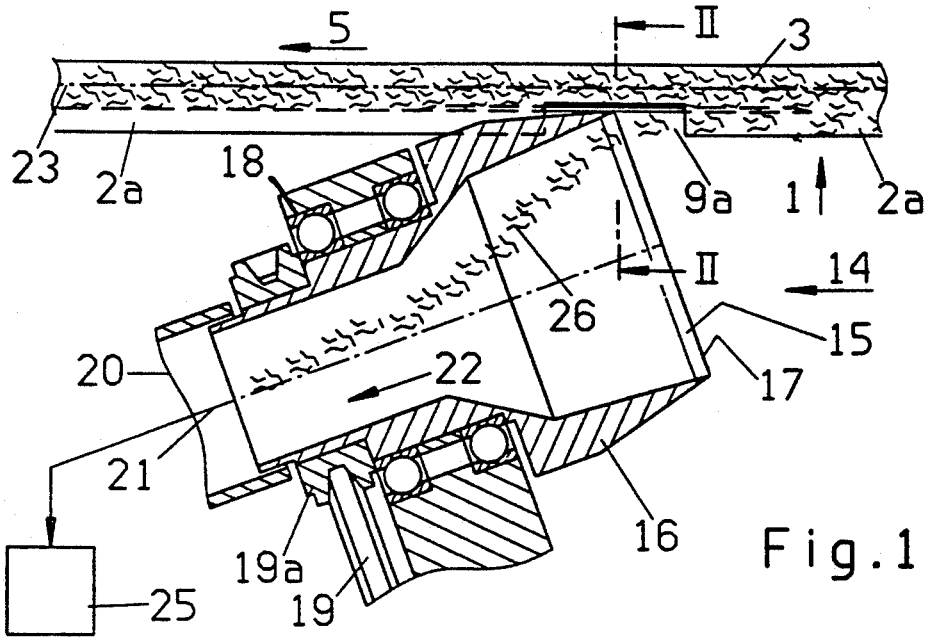
Fig.1
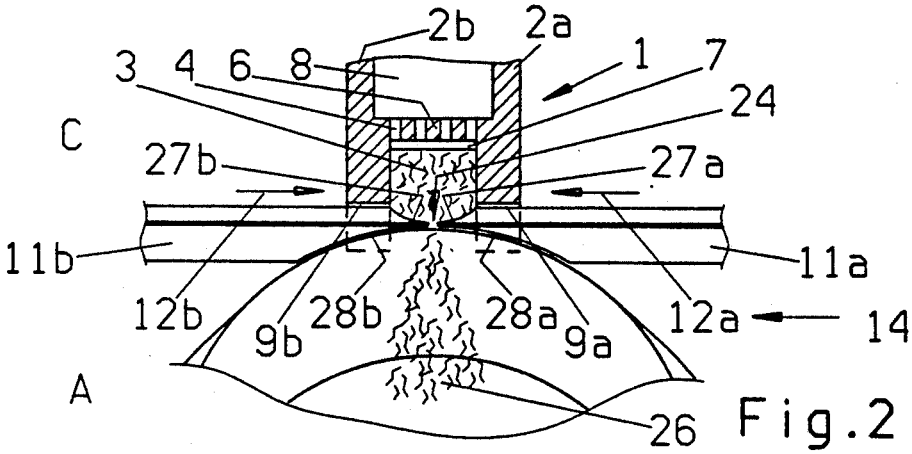
Fig.2
Fig.3
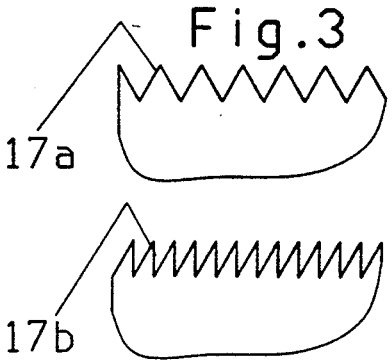
Fig.4
Fig.5
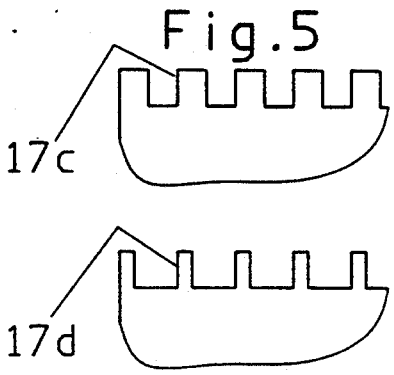
Fig.6

APPARATUS FOR REMOVING SURPLUS FROM A STREAM OF FIBROUS MATERIAL

BACKGROUND OF THE INVENTION

The invention relates to improvements in so-called trimming or equalizing apparatus which can be utilized with advantage in the tobacco processing industry to remove the surplus from a moving stream of fibrous material, such as particles of tobacco or particles of filter material for tobacco smoke. Trimming or equalizing apparatus of the class to which the present invention pertains can be utilized in so-called rod making machines for the mass production of plain cigarettes, cigars or cigarillos. The following description will discuss primarily trimming or equalizing apparatus which are used for the removal of surplus from moving tobacco streams; however, it is to be understood that the apparatus can be utilized with equal or similar advantage for the removal of surplus from streams or similar accumulations containing other types of materials including filter material for tobacco smoke.

As a rule, surplus tobacco is removed from a moving continuous stream by an apparatus which defines a channel for the stream and employs a foraminous belt conveyor cooperating with a suction chamber to advance the stream in the channel past two coplanar trimming discs which extend into the stream so that the surplus is located at one side and the remaining (trimmed or equalized) stream is located at the other side of the common plane of the discs. The marginal portions of the discs clamp the stream in such a way that the surplus extends beyond their common plane and is removed by a rotary implement in the form of a paddle wheel or a cylindrical brush whose axis of rotation is inclined with reference to the direction of advancement of the stream in the channel. The paddles or the bristles sweep the surplus away from the remainder of the stream, not only at the locus where the marginal portions of the discs come nearest to each other but also upstream and downstream of such locus. The particles which are located upstream and downstream of the aforementioned locus are not clamped by the discs so that they, and some particles which are interlaced therewith, are actually extracted from the mass of tobacco particles at the other side of the common plane of the discs. This affects the appearance and density of the trimmed stream because the bristles or paddles remove the surplus as well as varying quantities of material which is supposed to form part of the trimmed stream, i.e., which should not be removed from the stream. The quality of the trimming or equalizing action is not improved by causing the marginal portions of the discs to move at a speed having, at the aforementioned locus, a component of movement in the direction of advancement of the stream which matches or approximates the speed of the stream.

Commonly owned U.S. Pat. No. 4,651,755 granted Mar. 24, 1987 to Rudszinat discloses an apparatus for trimming a stream of smokable material. The apparatus of Rudszinat employs a substantially disc-shaped surplus removing member having a slightly conical peripheral surface and a slightly conical front surface. The neighboring portions of the two surfaces are notched so that the peripheral surface is provided with teeth which are to segregate the surplus from the remaining major portion of the moving stream. The relatively wide peripheral surface of the disc can remove tobacco particles at the upstream side and/or at the downstream side of the location where the marginal portions of the two discs come nearest to each other.

The disclosure of the patent to Rudszinat is incorporated herein by reference.

OBJECTS OF THE INVENTION

An object of the invention is to provide a trimming or equalizing apparatus whose surplus removing action is more predictable than that of heretofore known apparatus.

Another object of the invention is to provide an apparatus which is designed to remove only the surplus of tobacco or other fibrous material from a stream which is transported by a belt conveyor or the like.

A further object of the invention is to provide novel and improved particle engaging members for use in the above outlined apparatus.

An additional object of the invention is to provide a novel and improved material removing tool for use in the above outlined apparatus.

Still another object of the invention is to provide a novel and improved combination of material engaging members and material removing tool for use in the above outlined apparatus.

A further object of the invention is to provide the apparatus with novel and improved means for evacuating the removed surplus.

Another object of the invention is to provide a versatile material removing tool for use in the above outlined trimming or equalizing apparatus.

An additional object of the invention is to provide an apparatus which constitutes an improvement over and a further development of apparatus disclosed in the patent to Rudszinat.

Still another object of the invention is to provide a novel and improved method of avoiding removal of material other than surplus from a moving stream or flow of fibrous material, particularly tobacco particles or fibrous filter material for tobacco smoke.

A further object of the invention is to provide a novel and improved method of disposing of removed surplus in an apparatus of the above outlined character.

Another object of the invention is to provide a trimming or equalizing apparatus which can be installed in existing machines or production lines as a superior substitute for heretofore known and used trimming apparatus.

An additional object of the invention is to provide an apparatus which can be utilized in machines for the making of cigarettes with so-called dense ends.

SUMMARY OF THE INVENTION

The invention is embodied in an apparatus for removing a surplus of particulate material, such as tobacco, from a stream of such material. The improved apparatus comprises means (such as an endless foraminous belt conveyor) for moving the stream lengthwise along a predetermined path, and two rotary material engaging members which have marginal portions extending into the path so that the surplus of material is located at one side of the rotary members. The marginal portions of the rotary members are nearest to each other at a predetermined point within the path, and the apparatus further comprises means for rotating the members in opposite directions, and means for removing the surplus including a driven cutting edge which removes the surplus at the aforementioned point and at the one side of the material engaging members.

The apparatus preferably further comprises a channel which defines the predetermined path.

In accordance with a presently preferred embodiment of the invention, the surplus removing means has an arcuate cutting edge, and such cutting edge may but need not be serrated.

The surplus removing means can comprise a rotary tube having an end which is adjacent the material engaging members, and the cutting edge is then disposed at the end of the tube. The moving means is designed to transport the stream in a predetermined direction, and the rotary tube is preferably positioned in such a way that its axis of rotation makes with the predetermined direction an oblique angle, e.g., a relatively small acute angle.

The tube can define a passage for evacuation of removed surplus, and the apparatus then preferably further comprises means for drawing the removed surplus into the passage through the end of the tube by suction.

The marginal portions can be configurated, at the one side of the material engaging members, in such a way that they at least substantially conform to the peripheral surface of the rotary tube at the aforementioned predetermined point. This reduces the likelihood that the removing means would remove appreciable quantities of material (or even any material) at locations other than the predetermined point. To this end, the marginal portions can be concave at the one side of the material engaging members.

It is further possible, and often desirable, to impart a concave shape to the marginal portions of the material engaging members at the other side of such members, i.e., at the side which confronts the remainder of the stream and is located opposite the one side.

The cutting edge can be designed in such a way that it comprises first portions which remove a first quantity of surplus, and recessed or pocketed second portions which remove a lesser second quantity of surplus.

The cutting edge is preferably positioned and configurated to remove surplus only, or practically only, at the predetermined point where the marginal portions of the two material engaging members come nearest to each other.

The moving means can form part of a tobacco rod making or filter rod making machine.

The aforementioned channel preferably comprises two sidewalls which flank the stream in the predetermined path, and each such sidewall can be provided with an opening (e.g., a slit or a recess) for one of the material engaging members.

If the moving means includes a foraminous belt conveyor, the apparatus preferably further comprises means (such as a suction chamber) which attracts the stream to the moving means. The trimmed or equalized stream constitutes a rod-like filler which is ready to be draped into cigarette paper or other suitable wrapping material to form a continuous rod which is to be subdivided into rod-shaped articles of unit length or multiple unit length.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain presently preferred specific embodiments with reference to the accompanying drawings.

BRIEF DESCRIPTION OF THE DRAWINGS

FIG. 1 is a central longitudinal vertical sectional view of a trimming or equalizing apparatus which embodies one form of the invention and is installed in a cigarette rod making machine;

FIG. 2 is an enlarged fragmentary transverse vertical sectional view substantially as seen in the direction of arrows from the line II—II of FIG. 1;

FIG. 3 is a fragmentary developed view of a material removing tool with a serrated cutting edge;

FIG. 4 is a view similar to that of FIG. 3 but showing a cutting edge with serrations departing from those shown in FIG. 3;

FIG. 5 is a view similar to that of FIG. 3 but showing a cutting edge with a set of serrations which differ from those shown in FIGS. 3 and 4; and FIG. 6 is a view similar to that of FIG. 3 but showing serrations different from those shown in FIGS. 3 to 5.

DESCRIPTION OF THE PREFERRED EMBODIMENTS

FIGS. 1 and 2 illustrate an apparatus which comprises an elongated channel 1 having spaced apart parallel sidewalls 2*a*, 2*b* flanking a continuous stream 3 of particulate material, such as particles of tobacco ribs and/or tobacco leaf laminae which are to form the filler of a continuous cigarette rod. The right-hand portion of the stream 3 (as viewed in FIG. 1) carries a surplus 26 of tobacco particles. The means for moving the stream 3 in the direction of arrow 5 comprises an endless foraminous belt conveyor 7 having a lower reach adjacent the underside of a bottom wall 6 (actually top wall because the channel 1 is open from below) of the channel. The wall 6 is provided with apertures 4 which constitute suction ports leading to a suction chamber 8 which causes the stream 3 to adhere to the underside of the lower reach of the belt conveyor 7.

The sidewalls 2*a*, 2*b* are respectively provided with openings 9*a*, 9*b* in the form of cutouts which enable parts of two coplanar disc-shaped particle engaging members 11*a*, 11*b* to extend into the path of the moving stream 3 in such a way that the surplus 26 extends downwardly beyond the common plane of the members 11*a* and 11*b*. The members 11*a*, 11*b* are driven in opposite directions (denoted by the arrows 12*a*, 12*b*) by two shafts which are not shown in the drawing. Reference may be had to FIG. 2 in the patent to Rudszinat.

The character 24 denotes a point or locus (hereinafter called tangent point) where the marginal portions of the members 11*a*, 11*b* are nearest to each other. As shown in FIG. 2, the point 24 can be located midway between the sidewalls 2*a*, 2*b* of the channel 1. The direction of movement of successive points of the peripheral surfaces of the members 11*a*, 11*b* which approach and move through the point 24 is the same as that indicated by the arrow 5, and the peripheral speed of each marginal portion at the point 24 has a component extending in the direction of arrow 5 and matching the speed of the belt conveyor 7, i.e., of the stream 3. Thus, the surplus 26 which is clamped by the members 11*a*, 11*b* at the point 24 does not move relative to the peripheral surfaces of these members and vice versa.

The tool 14 which serves to remove the surplus 26 at, and possibly at locations immediately adjacent, the point 24 comprises a tube 16 which is driven to rotate about its longitudinal axis 21. The latter makes an acute angle with the direction which is indicated by the arrow 5. The right-hand end of the tube 16 (as viewed in FIG. 1) is located at the point 24 and can be said to constitute a sharp circular (arcuate) cutting edge 17 which serves to remove the surplus 26 at the point 24. That portion (15) of the tube 16 which is formed with the cutting edge 16 is made of a highly wear-resistant material and is preferably detachably affixed to the major portion of the tube so that it can be rapidly detached and replaced with a portion 15 having a fresh or sharpened cutting edge 17.

The major portion of the tube 16 is rotatable in anti-friction bearings 18 which are installed in the housing or frame of the cigarette rod making machine including the channel 1 and the belt conveyor 7. A pulley 19*a* on the major portion of the tube 16 is driven by a vee belt 19 which can receive motion from the main prime mover (not shown) of the rod making machine.

FIG. 1 shows a suction generating device 25 (e.g., a fan) which is connected to the other end of the major portion of the tube 16 to draw the separated surplus 26 into the axial passage 20 of the tube 16 for evacuation from the trimming apparatus and for delivery into a magazine, not shown, e.g., back to a magazine of a distributor (also called hopper) which is a standard part of a rod making machine and serves to form a carpet or layer consisting of tobacco particles and being ready for conversion into a stream corresponding to the stream 3 shown in FIGS. 1 and 2. The direction of evacuation of separated surplus 26 in the passage 20 of the tube 16 is indicated by an arrow 22.

In order to ensure that successive increments of the cutting edge 17 on the rotating tube 16 can actually reach and remove the surplus only at the point 24 between the peripheral surfaces of the members 11*a*, 11*b*, the marginal portions 28*a*, 28*b* of the members 11*a*, 11*b* are shaped with a view to ensure that they can closely conform to the outline of the adjacent end of the tube 24. To this end, the marginal portions 28*a*, 28*b* have a concave shape (see FIG. 2); such marginal portions are located at that side (A) of the members 11*a*, 11*b* which faces away from the wall 6, i.e., from the major portion of the stream 3.

If the underside of the trimmed stream (i.e., the rod-like filler 23 shown in the left-hand portion of FIG. 1) is to be provided with a convex surface, the marginal portions 27*a*, 27*b* of the members 11*a*, 11*b* at the other side (C) of the common plane of these members are also concave (as shown in FIG. 2) to thus facilitate conversion of the filler into a cylindrical rod during advancement through a wrapping station (not shown) where the filler 23 is draped into a web of cigarette paper or other wrapping material prior to being subdivided into rod-shaped articles of unit length or multiple unit length. The provision of concave or similarly shaped marginal portions 27*a*, 27*b* at those sides (C) of the disc-shaped members 11*a*, 11*b* which confront the mass of tobacco in the upper portion of the channel 1 exhibits the additional advantage that the thus formed relatively thin peripheral surfaces of the members 11*a*, 11*b* are less likely to entrain tobacco particles in a direction from the point 24 and sideways, namely toward the sidewalls 2*a*, 2*b* of the channel 11.

The aforedescribed configuration of the marginal portions 27*a*, 27*b* and 28*a*, 28*b* of the members 11*a*, 11*b*, combined with the provision of the cutting edge 17 at that end of the tube 16 which is immediately adjacent the point 24, ensures that the parts 11*a*, 11*b* and 16 cooperate to remove the surplus 26 only at or in the immediate proximity of the point 24. This ensures the making of a more satisfactory filler 23 because the tube 16 cannot draw tobacco particles from those portions at the underside of the stream 3 which are located upstream and downstream of the point 24 (as seen in the direction of arrow 5), i.e., from the portions which are not pinched or clamped by the peripheral surfaces of the members 11*a*, 11*b* or are pinched or clamped less than at the point 24. This is in contrast to the construction and mode of operation of heretofore known trimming or equalizing apparatus wherein the means for removing the surplus includes a cylindrical brush, a paddle wheel or a like tool designed to sweep tobacco particles off a relatively large portion of the adjacent side of a moving stream of tobacco particles or the like.

FIG. 1 shows that the cutting edge 17 of the tube 16 is smooth, i.e., it is devoid of notches or other depressions and forms an uninterrupted circle. FIGS. 3, 4, 5 and 6 show four modified cutting edges 17*a*, 17*b*, 17*c*, 17*d* which are provided with serrations in the form of relatively small triangular, substantially square or rectangular teeth. Those configurations which are shown in FIGS. 3 to 6 are merely examples of a wide variety of cutting edges which can be provided on the portion 15 of the tube 6 to remove the surplus 26 only at or perhaps also in immediate proximity to the point 24.

The improved apparatus can be converted for the making of so-called cigarettes, cigars or cigarillos with dense ends. The fillers of such articles contain more tobacco at the ends, particularly at the ends which are to be lighted, in order to reduce the likelihood of escape of tobacco particles and the contamination of the pocket or purse of the purchaser. The marginal portions of the members 11*a*, 11*b* are then provided with so-called pockets (refer to the pockets 14*a* in FIG. 1 of the patent to Rudszinat) which ensure that the corresponding portions of the filler 23 contain more tobacco than the other portions. When the filler is thereupon draped into cigarette paper or the like, it is severed at or across the filler portions which contain more tobacco so that the respective end or ends of the thus obtained rod-shaped articles constitute the so-called dense ends. Such mode of making cigarettes, cigars or cigarillos with dense ends is well known in the art of tobacco processing. In order to enable the improved surplus removing tool 14 to cooperate with disc-shaped tobacco clamping members of the type shown in FIG. 1 of the patent to Rudszinat, the cutting edge is provided with first portions which remove the surplus between successive pockets at the marginal portions of the members 11*a*, 11*b*, and recessed second portions which remove the surplus at the pockets. This results in the formation of a rod-like filler which includes uniformly spaced-apart portions containing larger quantities of tobacco particles.

The mode of operation of the improved trimming or equalizing apparatus which is shown in FIGS. 1 and 2 is as follows:

The belt conveyor 7 is driven to advance the stream 3 in the direction of arrow 5 along the path which is defined by the channel 1 and is flanked by the sidewalls 2*a*, 2*b*. The suction chamber 8 ensures that the stream 3 is attracted to the underside of the lower reach of the belt conveyor 7 and that successive increments of such stream 30 advance toward, past and beyond the trimming station at the point 24. The members 11*a*, 11*b* extend into the path for the stream 3 through the respective openings 9a, 9b and are spaced apart from the wall 6 a distance which is required to ensure that the rod-like filler 23 will contain a desired quantity of particulate material, i.e., that the filler of the cigarette rod will exhibit a certain hardness.

The surplus 26 of successive increments of the stream 3 is clamped between the marginal portions of the members 11a, 11b at the point 24, i.e., where the surplus is removed by successive increments of the cutting edge 17 on the rotating tube 16. The thus trimmed stream 3 constitutes the filler 23 which is transported into the aforediscussed wrapping mechanism to be condensed and simultaneously draped into cigarette paper or other suitable wrapping material.

The removed surplus 26 is drawn into the passage 20 of the tube 16 by the intake of the suction generating device 25 and is conveyed in the direction of arrow 22, preferably back into the distributor of the rod making machine which includes the improved apparatus. Such mode of evacuating the removed surplus is desirable and advantageous because the surplus is treated gently so that its particles are not unduly comminuted on their way into and within the tube 16. The reason is that the separated surplus 26 undergoes a minimum of deflection (see FIG. 1) on its way from the point 24 into the interior of the tube 16. This is in contrast to the operation of conventional trimming or equalizing apparatus wherein the removed surplus is subjected to pronounced mechanical stresses, not only during separation (by the bristles of a brush or by the paddles of a paddle wheel) but also during subsequent transport toward a magazine or the like.

Another important advantage of the improved apparatus over conventional apparatus (including that disclosed in the patent to Rudszinat) is that the aforediscussed configuration of marginal portions 28a, 28b of the members 11a, 11b renders it possible to achieve a highly localized surplus removing action, i.e., to limit the removal of tobacco only to those particles which are positively and reliably clamped by the members 11a, 11b at the point 24. Thus, a tangent to an increment of the cutting edge 17 at the point 24 practically coincides with the tangents to the nearest portions of the members 11a, 11b so that the cutting edge 17 and/or any other part of the tube 16 does not extract tobacco particles at those parts of the underside of the stream 3 where the particles are not positively clamped by the peripheral surfaces of the members 11a and 11b. As can be seen in FIG. 1, the orientation of the tube 16 is such that its cutting edge 17 cannot sever any particles upstream of the point 24. The cutting edge 17 can be said to perform a so-called traction cut which is highly desirable and advantageous for the appearance and quality (uniformity) of the filler 23.

The provision of concave marginal portions 27a, 27b exhibits the aforediscussed advantage that the peripheral surfaces of the members 11a, 11b are much less likely to entrain tobacco particles from the point 24 toward the respective sidewalls 2a, 2b while they advance from the point 24 toward the respective openings 9a, 9b. This is due to the fact that the relatively narrow peripheral surfaces can be more readily separated from the tobacco particles and permit such particles to continue their movement in the direction of arrow 5.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. Apparatus for removing a surplus of material from a stream, comprising means for moving the stream lengthwise along a predetermined path; two rotary material engaging members having marginal portions extending into said path so that the surplus of material is located at one side of said members, said marginal portions being nearest to each other at a predetermined point within said path; means for rotating said members in opposite directions; and means for removing the surplus including a driven cutting edge which removes the surplus at said point and at said one side of said members, said surplus removing means comprising a rotary tube having an end adjacent said members and said cutting edge being disposed at said end of said rotary tube.

2. The apparatus of claim 1, further comprising a channel which defines said predetermined path.

3. The apparatus of claim 1, wherein said cutting edge is arcuate.

4. The apparatus of claim 1, wherein said cutting edge is serrated.

5. The apparatus of claim 1, wherein said moving means includes means for transporting the stream in a predetermined direction, said tube having an axis making an oblique angle with said predetermined direction.

6. The apparatus of claim 1, wherein said tube defines a passage for evacuation of removed surplus.

7. The apparatus of claim 6, further comprising means for drawing the removed surplus into said passage through the end of said tube by suction.

8. The apparatus of claim 1, wherein said tube has a peripheral surface at said end thereof and said marginal portions are configurated at said one side to at least substantially conform to said peripheral surface at said point.

9. The apparatus of claim 8, wherein said marginal portions are concave at said one side of said members.

10. The apparatus of claim 1, wherein said marginal portions are concave at another side of said members opposite said one side.

11. The apparatus of claim 1, wherein said cutting edge has first portions which remove a first quantity of surplus and recessed second portions which remove a lesser second quantity of surplus.

12. The apparatus of claim 1, wherein said cutting edge is positioned and configurated to remove surplus only at said predetermined point.

13. The apparatus of claim 1, wherein said moving means is adapted for use in a tobacco rod making machine.

14. The apparatus of claim 1, further comprising a channel which defines said path, said channel having two sidewalls which flank the stream in said path and each of said sidewalls having an opening for one of said members.

15. The apparatus of claim 1, further comprising means for attracting the stream to said moving means.

16. The apparatus of claim 1, wherein said moving means includes means for moving a stream of particulate material of the tobacco processing industry.

* * * * *